US009434504B2

(12) United States Patent
Fisher et al.

(10) Patent No.: US 9,434,504 B2
(45) Date of Patent: Sep. 6, 2016

(54) CONTAINERS WITH RECLOSABLE LIDS

(75) Inventors: Thad J. Fisher, DeForest, WI (US); Charles W. Halgren, East Hanover, NJ (US); Kyle Gati, Deerfield, IL (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 1000 days.

(21) Appl. No.: 13/536,933

(22) Filed: Jun. 28, 2012

(65) Prior Publication Data

US 2014/0000224 A1 Jan. 2, 2014

(51) Int. Cl.

| | |
|---|---|
| ***B65D 43/16*** | (2006.01) |
| ***B65B 69/00*** | (2006.01) |
| ***B65D 5/68*** | (2006.01) |
| ***B65D 47/24*** | (2006.01) |

(52) U.S. Cl.

CPC ..... *B65D 5/68* (2013.01); *B65D 47/242* (2013.01); *B65D 47/243* (2013.01); *B65D 2101/0023* (2013.01)

(58) Field of Classification Search

USPC ..... 220/811; 229/404, 125.01, 906.1

See application file for complete search history.

(56) References Cited

U.S. PATENT DOCUMENTS

| | | | |
|---|---|---|---|
| 924,681 | A | 6/1909 | Ludescher |
| 1,431,918 | A | 10/1922 | Arthur |
| 3,416,718 | A | 12/1968 | Nakayama |
| 3,556,390 | A | 1/1971 | Gould et al. |
| 3,608,032 | A | 9/1971 | Boultinghouse |
| 4,610,039 | A | 9/1986 | Stern |
| 4,850,528 | A | 7/1989 | Hanus |
| 5,425,469 | A | 6/1995 | Freedland |
| 5,676,306 | A | 10/1997 | Lankin et al. |
| 6,161,474 | A | 12/2000 | Mason |
| 7,681,784 | B2 | 3/2010 | Lang |
| D616,301 | S | 5/2010 | Stephens |

(Continued)

FOREIGN PATENT DOCUMENTS

| | | | |
|---|---|---|---|
| CN | 1177327 | A | 3/1998 |
| CN | 1206385 | A | 1/1999 |

(Continued)

OTHER PUBLICATIONS

International Preliminary Report on Patentability dated Dec. 31, 2014 and Written Opinion of the International Searching Authority for International Application No. PCT/US2013/047246 (5 pgs.).

(Continued)

*Primary Examiner* — Christopher Demeree

(74) *Attorney, Agent, or Firm* — Fitch, Even, Tabin & Flannery LLP

(57) ABSTRACT

A reclosable food container is provided. The container has a body for storing a food product. The body has a side wall extending between a closed bottom end and a top end including an access opening. The body has a lid including a collar surrounding the body, the collar having a plurality of panels extending therefrom. The collar is movable relative to the body in a direction between a first position wherein the panels overlie and restrict access to the opening and a second position. The second position is closer to the bottom end of the body than the first position. The panels permit access to the opening and are configured to shift in an outwardly direction during contact with the top end of the body during movement of the collar from the first position toward the second position.

24 Claims, 4 Drawing Sheets

(56) References Cited

U.S. PATENT DOCUMENTS

| | | | | |
|---|---|---|---|---|
| 7,726,551 | B2 | 6/2010 | Abbott | |
| D620,793 | S | 8/2010 | Stephens | |
| 7,780,037 | B2 * | 8/2010 | Corbellini et al. | 220/813 |
| D705,052 | S * | 5/2014 | Huang et al. | D9/432 |
| D708,058 | S * | 7/2014 | Salamon-Hickey et al. | D9/435 |
| 2009/0001080 | A1 | 1/2009 | Mirabile et al. | |
| 2011/0095074 | A1 | 4/2011 | Stephens | |

FOREIGN PATENT DOCUMENTS

| | | | |
|---|---|---|---|
| CN | 1399603 | A | 2/2003 |
| EP | 0567249 | A1 | 10/1993 |
| FR | 2354249 | A1 | 1/1978 |
| FR | 2516896 | A1 | 5/1983 |
| GB | 735920 | A | 8/1955 |
| GB | 2275672 | A | 7/1994 |
| WO | 2007051884 | A1 | 5/2007 |

OTHER PUBLICATIONS

Notification of the First Office Action dated Feb. 1, 2016 for Chinese Patent Application No. 201380034471.8, English translation (8 pgs.).

Communication Pursuant to Article 94(3) dated Jan. 20, 2016 for European Patent Application No. 13734270.5 (5 pgs).

Office Action Mailed Feb. 9, 2016 for Russian Patent Application No. 2014152480, English translation (4 pgs.).

* cited by examiner

CONTAINERS WITH RECLOSABLE LIDS

FIELD

Food product containers with lids are described herein, and in particular, food product containers with lids that open and close.

BACKGROUND

Food products such as cookies, crackers and chips can be stored in a wide variety of plastic and paper-based containers. Such containers can include a separate lid that can be attached to a lip of a body of the container. Typically, such lids are manufactured separately from the container and increase the total cost of the container. In addition, separate plastic lids can confuse the consumer with complicated functionality or become misplaced.

Some containers are formed from one or more paperboard blanks that are divided by fold lines into a plurality of panels. Such containers can be cheaper to produce than containers with separate lids. The panels can provide an attractive lid which can also protect the food product inside the container. Some examples of such containers are described in U.S. Pat. No. 4,850,528, U.S. Pat. No. 7,726,551, and U.S. Publication No. 2011/0095074. A disadvantage of such lids is that six or more such panels have to be simultaneously or sequentially manipulated when opening or closing such containers, which can make the opening and closing of the container a difficult and time consuming process.

SUMMARY

A reclosable food container is provided. The container has a body for storing a food product. The body has a side wall extending between a closed bottom end and a top end including an access opening. The body has a lid including a collar surrounding the body, the collar having a plurality of panels extending therefrom. The collar is movable relative to the body in a direction between a first position wherein the panels overlie and restrict access to the opening and a second position. The second position is closer to the bottom end of the body than the first position. The panels permit access to the opening and are configured to shift in an outwardly direction during contact with the top end of the body during movement of the collar from the first position toward the second position. The lid assembly of the container provides a visually appealing and intuitive opening and closing experience.

The lid can include a hinged intersection between the panels and the collar. The intersection can be positioned above the top end of the body when the collar is in the first position. The hinged intersection can be positioned below the top end of the body when the collar is in the second position. The panels can shift in the outwardly direction about the hinged intersection during the movement of the collar from the first position toward the second position to permit access to the opening.

The panels can shift in an inwardly direction about the hinged intersection during the movement of the collar from the second position toward the first position to restrict, access to the opening. The panels can be biased toward an inwardly direction. Each of the panels can have two curved sides and a third side forming a linear hinged intersection with the collar. The collar and the panels can be separated by a fold line. At least two adjacent panels can be joined via at least one recessed panel and the recessed panel can be joined to the adjacent panels by at least one fold line.

The container can include a stop configured to restrict the collar from moving from the second position past the first position. The container can also include a stop configured to restrict the collar from moving from the first position toward the bottom end past the second position.

The panels can be configured to form a dome when the collar is in the first position. The panels can be configured to form a concave surface when the collar is in the first position. The collar can be configured to rotate and twist at least a portion of the side wall to block access to the opening.

In one approach, the side wall can include a first threaded portion and the lid assembly includes a complementary second threaded portion that permits the lid assembly to be attached to the body of the container by rotation. The lid assembly is configured to move from the first position toward the second position by rotational movement alone the first threaded portion.

A method of using the container is also provided. The method includes moving the collar in a direction from the first position toward the second position; bringing the panels into contact with the top end of the body to shift the panels outwardly and permit access to the opening; and removing the food product from the container. The method can further include moving the collar from the second position toward the first position to allow the panels to shift inwardly, optionally at least partially under self-bias, to restrict access to the opening.

DETAILED DESCRIPTION

Figure 1:
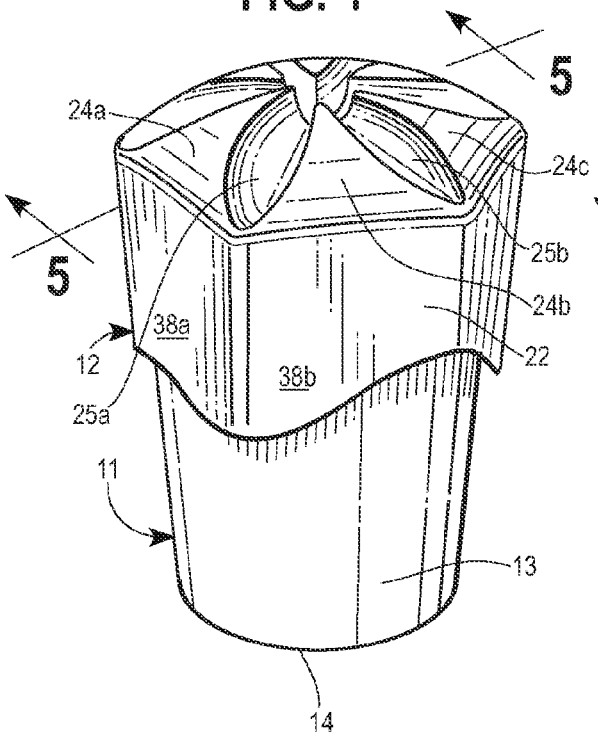
FIG. 1 is a side perspective view of an exemplary container with a lid, shown with the lid being closed and at a first elevational position.

A food storage container includes a body and a lid assembly movable with respect to the body. The lid assembly includes a collar surrounding the body and a plurality of panels extending therefrom. With the collar being in a first position, the panels cover an access opening of the container and restrict access to a food product stored in the container.

When the collar is moved toward a second position, the panels pivot away from the access opening to provide access to the food product in the container. A comparatively simple downward movement can result in a more complex outward movement of the panels. The panels can have decorative shapes resembling, for example, flower petals.

When being opened by a user, the panels of the lid assembly can imitate a blooming flower to provide a user with a visually pleasing experience. The container can be reclosed by moving the collar back to the first position such that the panels return to their closed orientation, such as due to a self-bias from the shape and orientation of the panels. Again, simple movement of the collar results in a more complex inward movement of the panels. Thus, the container advantageously has a lid that can be both decorative and provide a way to open and reclose the container using simple movements of the collar which translate into complex movements of the panels.

With reference to FIGS. 1-6, an exemplary container 10 with a body 11 and a lid assembly 12 is provided. The body 11 of the container 10 includes a side wall 13, a bottom end 14, and a top end 16 opposite the bottom end 14. The body 11 also includes a hollow interior 18 where a food product can be stored. For example, the food product may be candy, crackers, cookies, wafers, chocolate, cheese, raisins, nuts, grains, or the like. The top end 16 of the body 11 surrounds an access opening 20 through which the food product can be removed or dispensed from the container 10. A central axis passing through the opening 20 would also pass through the bottom end 14 of the body 11.

The body 11 of the container 10 can be in the form of a cup, a bag, or the like. The body 11 of the container 10 can be rigid and made from a paper, cardboard, plastic or the like. Alternatively, the body 11 of the container 10 can be made of a flexible material such as film, polyethelyne, polypropylene, polyvinyl chloride, polystyrene, polytetrafluoroethylene, or the like, so that the shape of the food product in the container 10 would impart a shape to the body 11. It is to be appreciated that the body 11 can be entirely rigid, entirely flexible, or rigid in part and flexible in part. The body 11 can be formed by injection molding, blow molding, or the like.

Figure 2:
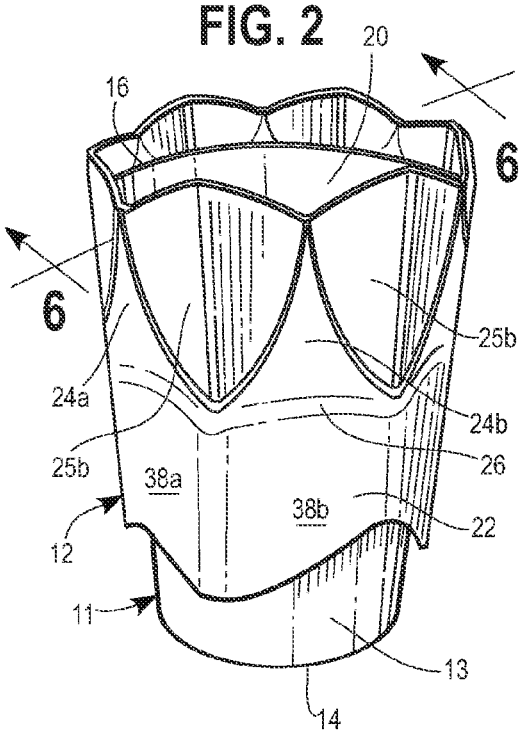
FIG. 2 is a side perspective view of the container of FIG. 1, shown with the lid having been moved downward to a second elevational position and being open.
Figure 3:
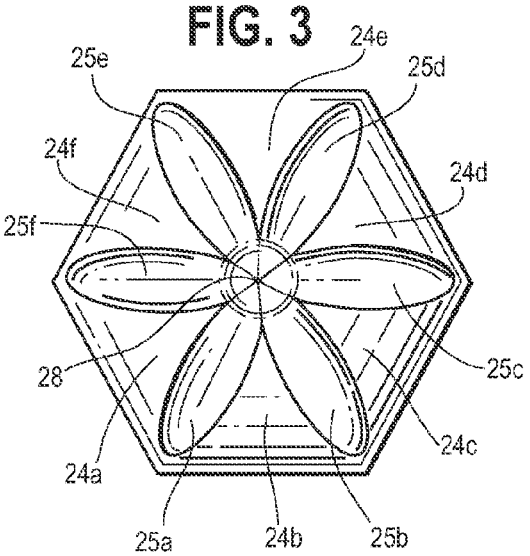
FIG. 3 is a top plan view of the container of FIG. 1 showing the lid closed.

With reference to FIGS. 1-3, the lid assembly 12 includes a collar 22. The collar 22 surrounds the side wall 13 of the body 11 of the container 10. The lid assembly 12 further includes a plurality of panels 24*a-f* extending from the collar 22 and being separated from one another by creases or fold lines. Intermediate sections 25*a-f* interconnect the panels 24*a-f*. Intermediate sections 25*a-f* can be recessed relative to the panels 24*a-f*. An intersection 26 is formed in the lid assembly 12 between the panels 24 and the collar 22. The intersection 26 can be a fold line or a crease and can serve as a pivot point between the panels 24*a-f* and the collar 22 as discussed in more detail below.

The collar 22 can be hexagonal as shown in FIG. 3, but may have a round, octagonal, rectangular, or any other suitable shape. The collar 22, the panels 24*a-f*, and the intermediate sections 25*a-f* can be made from paperboard, polymer, polymer laminated paper, or plastic materials, and more specifically, can be made from polypropylene, polyvinyl chloride, polystyrene, polytetrafluoroethylene, or the like. The collar 22, the panels 24*a-f*, and the intermediate sections 25*a-f* can optionally be self-biasing and can incorporate a memory-shape material so that the panels 24*a-f* can open from a closed position and later return back no the closed position.

Figure 5:
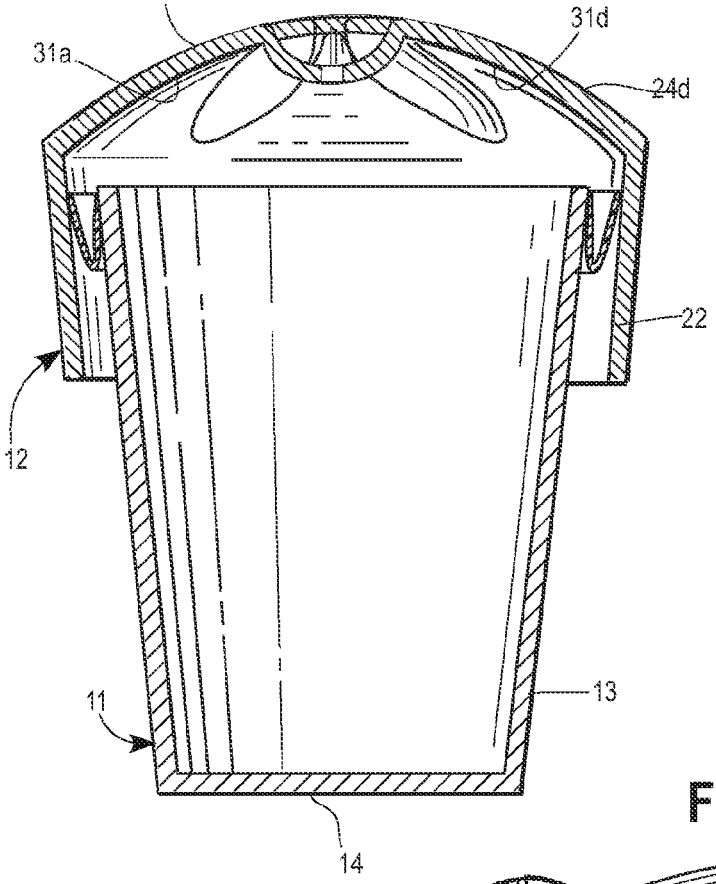
FIG. 5 is a side elevational view in section of the container of FIG. 1.

With reference to FIG. 5, the body 11 of the container 10 and the lid assembly 12 can be attached to one another by a flexible film 29 as shown in FIG. 5. One end of the flexible film 29 can be attached to the side wall 13 of the body 11 and the other end of the flexible film 29 can be attached to the collar 22 of the lid assembly 12 such as by using an adhesive or the like. The length of the flexible film 29 can be chosen such that the collar 22 is permitted to move downward from a first (closed) position shown in FIG. 5 to a second (open) position shown in FIG. 6. Since the film 29 is maximally stretched when the collar 22 is in the open position, the collar 22 is restricted from moving downward toward the bottom end 14 of the body 11 past the open position. Similarly, the length of the film 29 can restrict the collar 22 from moving upward past a position where the film 29 is maximally stretched out.

As such, the film 29 can act as a stop for the collar 22 to restrict motion of the collar 22 both in the upward and downward directions. The upward stop can be useful, for example, because the upward stop can restrict the user from inadvertently taking the lid assembly 12 off the body 11 of the container 10 when moving the lid assembly 12 upward with the intention of reclosing the container 10. The film 29 can be made from a material that is flexible but sufficiently strong to prevent ripping of the film 29 when it is being stretched out. For example, the film 29 can be made of metalized or non-metalized polyethylene or polypropylene. It is to be appreciated that as an alternative to the film 29, the lid assembly 12 may be in a friction fit with the side wall 13 of the body 11. In another approach, the lid assembly 12 may be attached to the side wall 13 of the body 11 of the container 10 by an adhesive or other suitable means.

The panels 24*a-f* of the lid assembly 12 have two positions of stability—the closed position shown in FIG. 1 and the open position shown in FIG. 2. With reference to FIG. 1, when the collar 22 is in a first (closed) position, the panels 24*a-f* are biased toward the central axis of the body 11 and overlie the access opening 20 to restrict access to the food product stored in the body 11. The configuration of the panels 24*a-f* and intermediate sections 25*a-f* is such that a pin hole 28 may formed in the center of the lid assembly 12 when the panels 24*a-f* are a closed position as shown in FIG. 3. However, the pin hole 28 is sufficiently small that the food product stored inside the body 11 is restricted from being removed or accidentally dispensed even when the container 10 is positioned on its side or upside down.

The panels 24*a-f* and intermediate sections 25*a-f* of the lid assembly 12 can be shaped and arranged in a variety of predetermined decorative patterns. For example, a flower shape as shown in FIG. 3 can be formed by six generally triangular panels 24*a-f* each having two curved sides and six oval intermediate sections 25*a-f*. As shown in FIGS. 1 and 5 the panels 24*a-f* may be arranged so as to form a dome over the top end 16 of the body 11 of the container 10. As such, each of the panels 24*a-f* has a convex outside surface when the collar 22 is in the closed position.

The body 11 may optionally be provided with an initial hermetic seal to protect the food product stored in the container 10. For example, a peelable film can be sealed to the top end 16 of the body 11 of the container 10. In this approach, after the collar 22 of the lid assembly 12 is moved toward the second (open) position and the panels 24*a-f* shift to the open orientation, a user could remove the peelable film to reveal the access opening 20 and gain access to the food products in the container 10. Thus, the peelable film can provide a tamper-evident feature such that the absence of the peelable film could indicate to the consumer that the container 10 has been previously opened.

In another approach, the peelable film could be sealed to the exterior surface of the panels 24*a-f* such that the user could peel off the film before moving the collar 22 to the open position. Alternatively, the film can be peeled off during movement of the collar 22 from the closed position (FIG. 1) toward the open position (FIG. 2), allowing the removal of the seal and the opening of the panels 24*a-f* to reveal the access opening 20 in one step.

In yet another approach, the panels 24*a-f* and the intermediate sections 25*a-f* of the lid assembly 12 can form an initial hermetic seal over the access opening 20 of the body 11. In this approach the lid assembly 12 can be utilized to open the seal utilizing one or more lines of weakness formed between one or more of the panels 24*a-f* and the intermediate sections 25*a-f* to tear the seal and open the lid assembly 12 upon the downward sliding of the collar 22 from the closed position to the open position. The line of weakness may be a score line or a perforation line formed in the seal between the panels 24*a-f*. The line of weakness can be formed by laser ablation, die-cutting, micro-abrasion, or the like.

Optionally, the container 10 may be provided with the panels 24*a-f* being at least in part concave such that when the container 10 is opened by a user and reclosed, the concave portions of the panels 24*a-f* pop up back to the dome-shaped or convex orientation shown in FIGS. 1 and 5. In this approach, the initial concavity of the panels 24*a-f* would provide a tamper-evident feature such that if the panels 24*a-f* were convex, the consumer could know that the container 10 has been previously opened.

With reference to FIG. 5, when the lid assembly 12 is in the closed position, the interior surfaces of the panels 24*a-f* (only interior surfaces 31*a* and 31*d* of the panels 24*a* and 24*d* are illustrated for simplicity) are spaced apart from the top end 16 of the body 11 of the container 10. In addition, the intersection 26 between the panels 24*a-f* and the collar 22 is positioned above the top end 16 of the body 11. It is to be appreciated that the intersection 26 can be positioned below the top end 16 of the body 11 when the lid assembly 12 is in the closed position.

Figure 4:
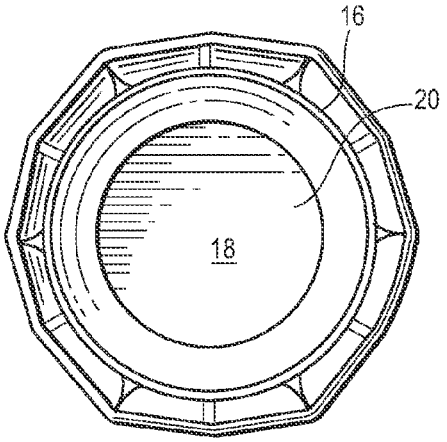
FIG. 4 is a top plan view of the container of FIG. 2 showing the lid open.

In order to open the container 10, a user can grasp the collar 22 of the lid assembly 12 and move the collar 22 in a direction toward the bottom end 14 of the container 10. As the collar 2 moves in a downward direction, the interior surfaces of the panels 24*a-f* come into contact with the top end 16 of the container 10. The panels 24*a-f* are then urged by the top end 16 of the container 10 to shift away from the central axis of the body 11 to an open orientation that provides the user access to the opening 20 as shown in FIGS. 2 and 4. In particular, the panels 24*a-f* and the intermediate sections 25*a-f* move from a closed orientation of FIG. 1 to an open orientation of FIG. 4 by pivoting about the intersection 26 between the panels 24*a-f* and the collar 22. The movement of the panels 24*a-f* and intermediate sections 25*a-f* from the closed to the open orientation resembles the blooming of a flower, which can be visually pleasing to many consumers.

Figure 6:
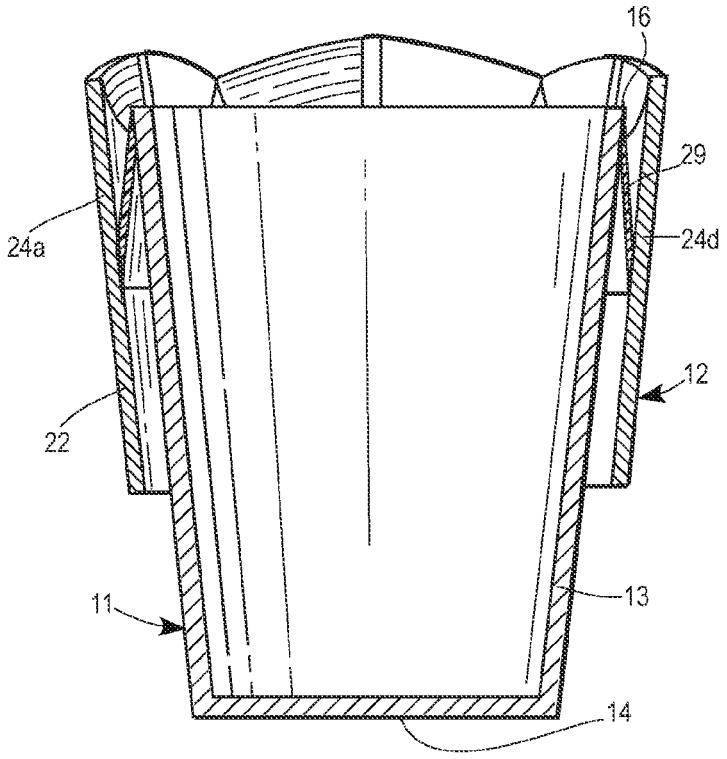
FIG. 6 is a side elevational view in section of the container of FIG. 2.

When the collar 22 is in the open position shown in FIG. 6, the intersection 26 is positioned between the top end 16 and the bottom end 14 of the body 11. More specifically, the intersection 26 can be positioned more than half way down between the top end 16 and the bottom end 14 of the body 11.

In reference to FIGS. 2 and 4, when the collar 22 is in the second position and the panels 24*a-f* are in the open orientation, the hollow interior 18 of the container 10 is exposed to the user such that the user can remove the food product from the container 10 through the access opening 20. After the user has removed some but not all of the food product from the container 10, the user may move the collar 22 in an upward direction away from the bottom end 14 and toward the closed position. As the collar 22 is being moved up by the user, the intersection 26 between the panels 24*a-f* and the collar 22 coincides with or crosses the top end 16 of the body 11, and the panels 24*a-f* pivot from the open orientation shown in FIG. 2 to the closed orientation shown in FIG. 1 to reclose the container 10. For the reasons discussed above, the closing of the lid assembly 12 resembles the closing of a flower, which many consumers may find visually appealing. The panels 24*a-f* can return to their initial closed position because the panels 24*a-f* can incorporate a shape-memory material.

Optionally, the container 10 can have a flexible side wall 13 and may be reclosed by rotating the collar 22 in a clockwise or counterclockwise direction about the central axis of the body 11. Since the collar 22 is connected to the flexible side wall 13 of the body 11 by the flexible film 29, a portion of the flexible side wall 13 would turn during the rotation of the collar 22 to form a twisted configuration that would reclose the container 10 by substantially blocking the access opening 20. In order to reopen a container 10 that has been reclosed, the collar 22 can be counter-rotated to untwist the twisted configuration such that the access opening 20 again becomes accessible such that the food product can be removed from the container 10. After the user removes the desired portion of the food product from the container 10, the food product remaining in the container 10 can be again reclosed as discussed above.

The container 10 can have a length as measured from the top end 16 to the bottom end 14 of about 2 inches (50 millimeters) to about 14 inches (350 millimeters), and a width of about 1 inch (25 millimeters) to about 6 inches (150 millimeters). The side wall 13 of the container 10 may have one or more layers and may have a thickness of about 0.005 inches (0.1 millimeters) to about 0.05 inches (1 millimeter). It is to be appreciated that the dimensions of the container 10 have been provided for illustration purposes only, and that the principles of this disclosure can be utilized in connection with flexible film packages of any size.

Figure 7:
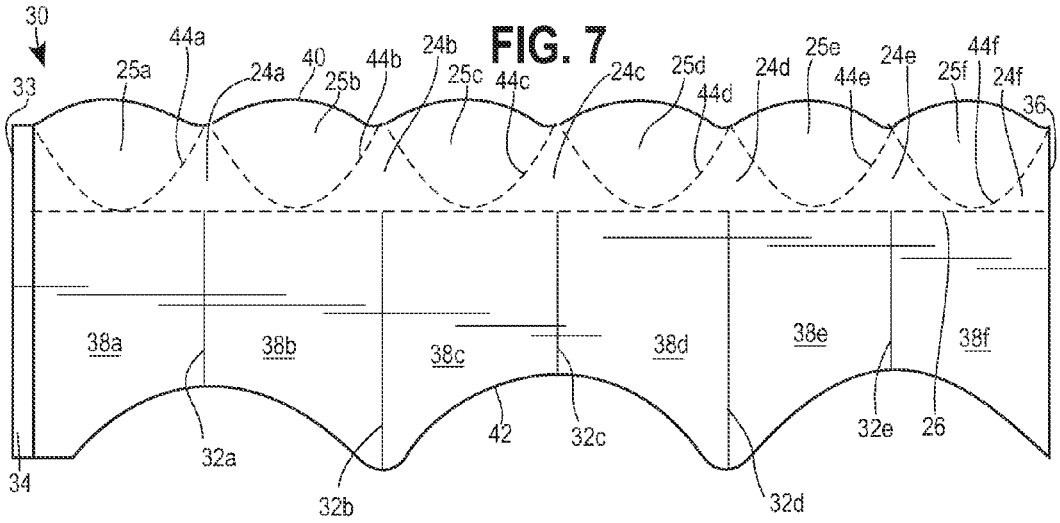
FIG. 7 is a plan view of an exemplary blank that can be used to form the lid of the container of FIG. 1.

With reference to FIG. 7, a method of making the lid assembly 12 of the container 10 from a blank material 30 is provided. The blank material 30 has a top end 40, a bottom end 42 opposite the top end 40, a first side 33 and a second side 36 opposite the first side 33. The blank material 30 has curved top and bottom ends 40 and 42, which give the finished lid assembly 12 a unique decorative shape as shown in FIG. 1. It is to be appreciated that one or both of the top and bottom ends 40 and 42 may also be at least in part straight. In addition, while the top end 40 has been shown to be convex and the bottom end 42 concave, the top end 40 may be concave, the bottom end 42 may be convex, or both top and bottom ends 40 and 42 may be convex or concave. The first side 33 of the blank material 30 can include a sealing area 34 which can be attached to the second side 36 of the blank material 30 by an adhesive or other suitable attachment means.

The blank material 30 is provided with a plurality of vertical fold lines 32*a-e*. The fold lines 32*a-e* can extend from the bottom end 42 of the blank material 30 and can be parallel, converging, or diverging relative to one another. Fold lines 32*a-e* divide the blank material 30 into six sections 38*a*-38*f*, which will form the sides of the hexagonal collar 22 when the blank material 30 is folded to form the lid assembly 12. The fold lines 32*a-e* can be formed by a laser or other suitable means and provide crisp or otherwise defined edges to the collar 22 as shown in FIGS. 1 and 3.

With continuing reference to FIG. 7, the blank material 30 is provided with a fold line which forms the intersection 26 between the panels 24*a-f* and the sides 38*a*-38*f* of the collar 22. The fold line 26 can extend between the sealing area 34 and the second side 36 of the blank material 30 and can be perpendicular to the fold lines 32*a-e*. It is to be appreciated that the fold line 26 can be at any other angle to the fold lines 32*a-e* and may be at least in part curved instead of being straight.

The blank material 30 is further provided with a plurality of fold lines 44*a-f* that can extend from the sealing area 34 to the second side 36 of the blank material 30. The fold lines 44*a-f* are curved and can be in an undulating, sinusoidal or any other suitable pattern. The portions of the blank material 30 formed between the intersection line 26 and the fold lines 44*a-f* define the panels 24*a*-24*f* of the lid assembly 12. The portions of the blank material 30 formed between the top end 40 and the fold lines 44*a-f* define the intermediate sections 25*a*-25*f* of the lid assembly. Similar to the fold lines 32*a-e*, the intersection line 26 and the fold lines 44*a-f* can be formed in the blank material 30 by a laser or by other suitable means. It is to be appreciated that any one of the fold lines may be formed by a partial removal of the material across the thickness of the blank material 30. Alternatively, any of the fold lines 32*a-f*, 26, and 44*a-f* can be formed by a complete removal of the material across the thickness of the blank material 30 so as to create a perforation line.

To construct the lid assembly 12, the blank material 30 shown in FIG. 7 can be folded such that the sealing area 34 at the first side 33 of the blank material 30 comes into close proximity with the second side 36 of the blank material 30. The sealing area 34 can be treated with an adhesive material such as glue or the like and the second side 36 of the blank material can be attached to the sealing area 34 by pinching the first and second sides 33 and 36 together to form the lid assembly 12. The lid assembly 12 can be attached to the container 10 using a flexible film 29 as described above. The described method provides for an easy and efficient way of manufacturing a reclosable lid assembly 12 for a food product storing container 10.

Figure 8:
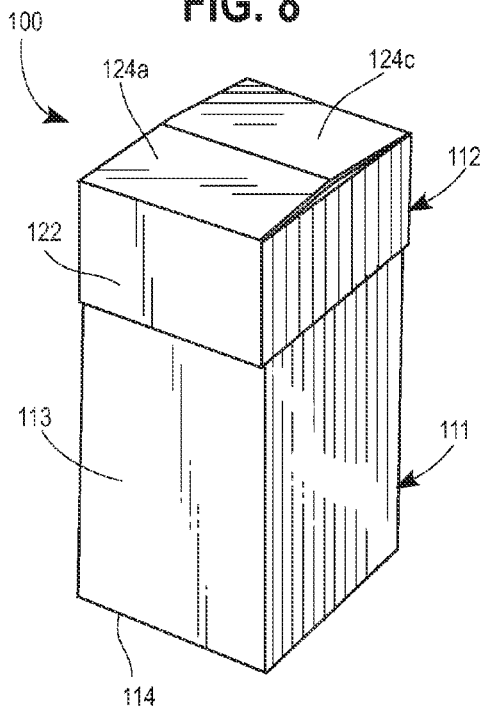
FIG. 8 is a side perspective view of another exemplary container with a lid assembly, shown with the lid being closed and at a first elevational position.
Figure 9:
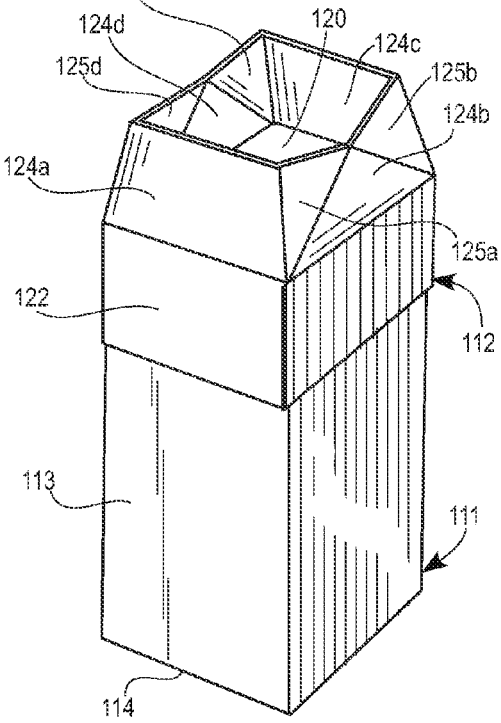
FIG. 9 is a side perspective view of the container of FIG. 8, shown with the lid having been moved downward to a second elevational position and being open.

With reference to FIGS. 8 and 9, an alternative exemplary food storage container 100 with a lid assembly 112 is provided. The container 100 has a body 111 with a side wall 113 and a bottom end 114. Unlike the generally cylindrical body 11 of the container 10, the body 111 of the container 100 has four sides such that the outer perimeter of the body 111 is generally square-shaped.

The lid assembly 112 has a collar 122 which extends around the side wall 113 of the body 111 and a plurality of panels 124*a-d* extending from the collar 122. The collar 122 is shaped and sized to match the outer perimeter of the body 111 of the container 100. The body 111 of the container 100 and the lid assembly 112 can be attached to one another by a flexible film similar to the film 29 shown in FIGS. 5 and 6 and discussed above. Alternatively, the lid assembly 112 may be in a friction fit with the side wall 113 of the container 100. Optionally, the lid assembly 112 may be attached to the side wall 113 of the container 100 by an adhesive.

The lid assembly 112 includes two generally rectangular panels 124*a* and 124*c* and two triangular panels 124*b* and 124*d* as shown in FIG. 9. Four triangular intermediate sections 125*a*, 125*b*, 125*c*, and 125*d* interconnect panels 124*a* and 124*b*, 124*b* and 124*c*, 124*c* and 124*d*, and 124*a* and 124*d*, respectively. The lid assembly 112 further includes an intersection 126 between the panels 124*a-d* and the collar 122. The intersection 126 serves as a pivot point between the panels 124*a-d* and the collar 122 similar to the intersection 26 discussed above. It is to be appreciated that while the collars 22 and 122 have been shown with six and four panels 24*a-f* and 124*a-d*, respectively, the collars 22 and 122 may have any suitable number of panels, for example, 2, 8, 10, 12, or more. It is also to be appreciated, that the collars 22 and 122 do not have to have an even number of panels and may have an odd number of panels, for example, 3, 5, 7, 9, 11, or more.

The body 111 of the container 100 and the lid assembly 112 can be made from the same materials as the body 11 and the lid assembly 12 of the container 10, respectively. Similarly to the collar 22 and the panels 24*a-f*, the collar 122, the panels 124*a-d*, and the intermediate sections 125*a-d* can incorporate a memory-shape material so that the panels 124*a-d* can open from a closed position and subsequently return back to the closed position.

The panels 124*a-d* of the lid assembly 112 have two positions of stability—the closed position shown in FIG. 8 and the open position shown in FIG. 9. When the collar 122 is in a first (closed) position, the panels 124*a-d* are biased toward the central axis of the body 11 and overlie the access opening 120 of the body 111. When the panels 124*a-d* are in a closed position, the food product is restricted from being removed or accidentally dispensed from inside the container 100 even when the container 100 is on its side or upside down.

It is to be appreciated that while the panels 124*a-d* have been shown in FIGS. 8-9 as having a non-decorative pattern, the panels 124*a-d* can be shaped and arranged to form any suitable decorative pattern, for example, a flower. As shown in FIG. 8, the panels 124*a-d* are arranged so as to form a flat exterior surface that is parallel to the bottom end 114 of the container 100. It is to be appreciated that the panels 124*a-d* can be oriented to form a convex or a concave surface instead of being flat.

The container 100 can be opened by the user substantially the same way as the container 10. More specifically, when the container 100 is in the closed position as shown in FIG. 8, the user can grasp the collar 122 of the lid assembly 112 and move the collar 122 in a direction toward the bottom end 114 of the container 100. As the collar 122 moves in a downward direction, the interior surfaces of the panels 124*a-d* come into contact with the top end of the container 100. The panels 124*a-d* are then urged by the top end of the container 100 to shift away from the central axis of the access opening 120 to an open position shown in FIG. 9.

The panels 124*a-d* move from the closed orientation of FIG. 8 to the open orientation shown in FIG. 9 by pivoting about the intersection 126 between the panels 124 and the collar 122. Again, similarly to the container 10, the movement of the panels 124*a-d* and the intermediate sections 125*a-d* from the closed to the open orientation resembles the blooming of a flower, which can be visually pleasing to the consumer.

After the use has removed some but not all of the food product from the container 100, the user may move the collar 122 in an upward direction away from the bottom end 114 toward the closed position. As the collar 122 is being moved up by the user, the intersection 126 between the panels 124*a-d* and the collar 122 coincides with or crosses the top end of the body 111. The since the panels 124*a-d* are biased toward the closed orientation, the panels 124*a-d* pivot from the open orientation shown in FIG. 9 to the closed orientation shown in FIG. 8 to reclose the container 100. The panels 124*a-d* can return to their initial position because the panels 124*a-d* can incorporate a shape-memory material.

Figure 10:
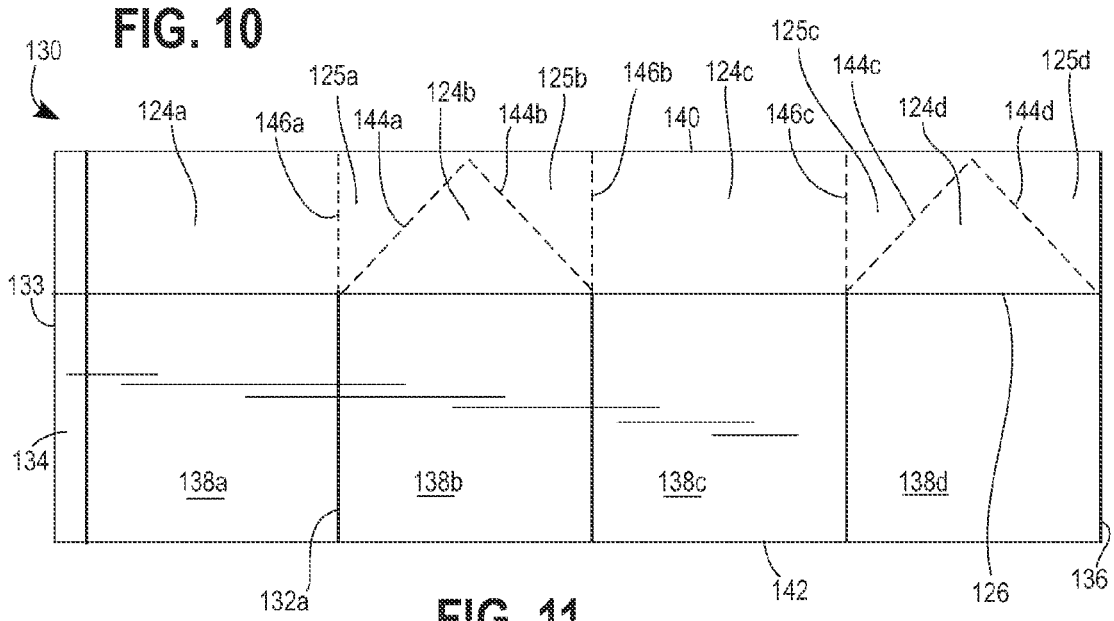
FIG. 10 is a plan view of an exemplary blank that can be used to form the lid of the container of FIG. 8.

With reference to FIG. 10, a method of manufacturing the lid assembly 112 using a blank material 130 is provided. The blank material 130 includes a top end 140, a bottom end 142 opposite the top end 140, a first side 133 and a second side 136 opposite the first side 133. The top and bottom ends 140 and 142 of the blank material 130 are straight and parallel to one another, but one or both of the top and bottom ends 140 and 142 can be at least in part curved. The blank material 130 can be made from the same material as the blank material 30 discussed above.

The blank material 130 is provided with a plurality of vertical fold lines 132*a-c*. The fold lines 132*a-c* can extend from the bottom end 142 of the blank material 130 and can be parallel, converging, or diverging relative to one another. The first side 133 of the blank material 130 can include a sealing area 134 which can be attached to the second side 136 of the blank material 130 by an adhesive or other suitable attachment means.

The fold lines 132*a-c* divide the blank material 130 into four sections 138*a*-138*d*, which will form the four sides of the collar 122 when the blank material 130 is folded to form the lid assembly 112. The fold lines 132*a-c* can be formed in the blank material 130 the same way as fold lines 32 can be formed in the blank material 30 discussed above.

The blank material 130 is provided with a fold line which forms the intersection 126 between the panels 124*a-d* and the sides 138*a*-138*d* of the collar 122. The fold line 126 can extend between the sealing area 134 and the second end 136 of the blank material 130 and is perpendicular to the fold lines 132*a-c*. It is to be appreciated that the fold line 125 can be at any other angle to the fold lines 132*a-c* and may be at least in part curved instead of being straight.

The blank material 130 is further provided with a plurality of fold lines 144*a-d*. The fold line 144*a* extends from the intersection of the fold line 132*a* and the fold line 126 to the top end 140 of the blank material 130. The fold line 144*b* extends from the intersection of the fold line 132*b* and the fold line 126 to the top end 140 of the blank material 130. The area between the fold lines 144*a*, 144*b*, and 126 forms the panel 124*b*, which can be in the form of an isosceles triangle as shown in FIG. 10.

The fold line 144*c* extends from an intersection of the fold line 132*c* and the fold line 126 to the top end 140 of the blank material 130. The fold line 144*d* extends from an intersection of the second end 136 and the fold line 126 to the top end 140 of the blank material 130. The area between the fold lines 144*c*, 144*d*, and 126 forms the panel 124*d*, which can be in the form of an isosceles triangle as shown in FIG. 10. It is to be appreciated that the panels 124*b* and 124*d* can be in a shape of a non-isosceles triangle or can be non-triangular.

With continuing reference to FIG. 10, the blank material 130 is provided with the fold lines 146*a-c* extending from the intersection of the fold lines 132*a-c*, respectively, with the fold line 126. The area between the sealing area 134, the top end 140, the fold line 146*a*, and the fold line 126 forms the panel 124*a* of the lid assembly 112. The area between the fold line 146*b*, the to end 140, the fold line 146*c*, and the fold line 126 forms the panel 124*c* of the lid assembly 112. The panels 124*a* and 124*c* have been shown as rectangular, but could be of any other suitable shape.

The area between the fold line 146*a*, the top end 140 and the fold line 144*a* forms the intermediate section 125*a*. The area between the fold line 144*b*, the top end 140, and the fold line 146*b* forms the intermediate section 125*b*. The area between the fold line 146*c*, the top end 140, and the fold line 144*c* forms the intermediate section 125*c*. The area between the fold line 146*d*, the to end 140, and the second side 136 of the blank material 130 forms the intermediate section 125*d*. Similar to the fold lines discussed in reference to FIG. 7, the fold lines shown in FIG. 10 can be made by a laser or by other suitable means.

To form the lid assembly 112, the blank material 130 of FIG. 10 can be folded such that the sealing area 134 at the first side 133 of the blank material 130 comes into close proximity with the second side 136 of the blank material 130. The sealing area 134 can be treated with an adhesive material such as glue and the second side 136 can be attached to the sealing area 134 by pinching the first and second sides 133 and 136 together to form the lid assembly 112. The lid assembly 112 can be attached to the container 100 using a flexible film or by a friction fit as described above. The described method provides for an easy and efficient way of manufacturing a reclosable lid assembly 112 for a food product storing container 100.

Figure 11:
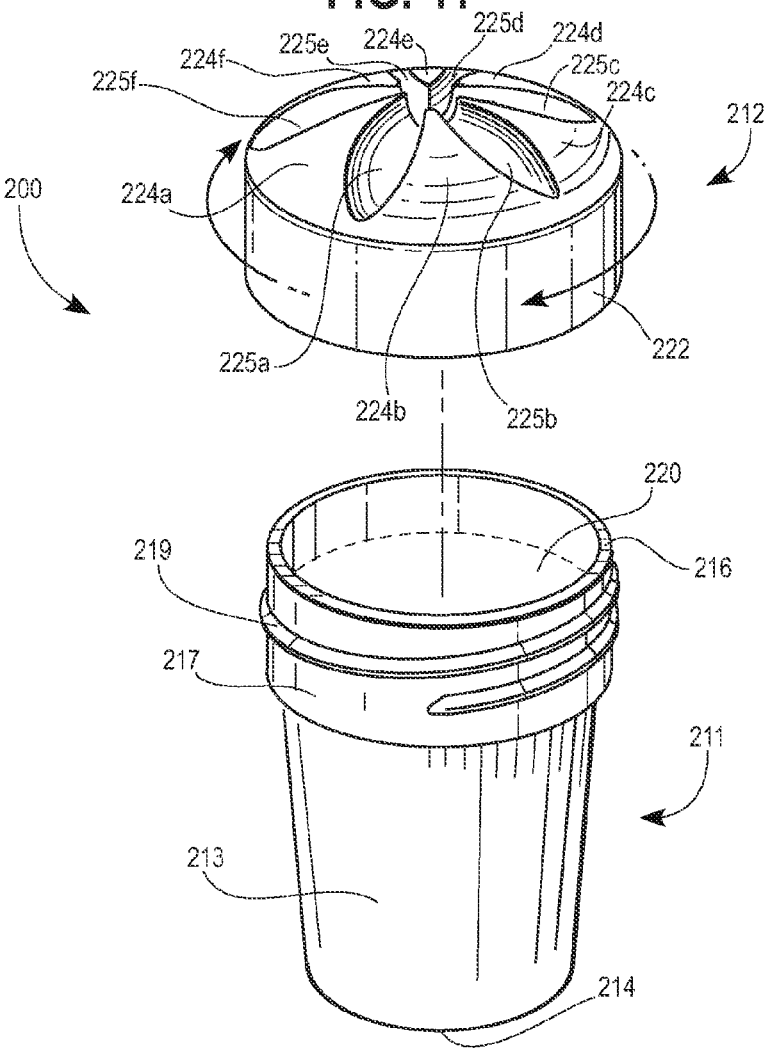
FIG. 11 is a perspective exploded view of another exemplary flexible container shown with a lid including threads.

With reference to FIG. 11, an exemplary container 200 in another form is provided. The container 200 includes a body 211 with a side wall 213, a bottom end 214, a top end 216 and an access opening 220. The body 211 of the container 200 further includes a rigid ring 217 including a thread 219. The rigid ring may be attached to the side wall 213 of the container 200 using an adhesive or the like. Optionally, instead of using a separate ring 217, the side wall 213 of the container 200 may have threads directly thereon. For example, if the container 200 is made from a polymer material, the side wall 213 may be UV cured to form a threaded surface.

The lid assembly 212 includes a collar 222 and a plurality of panels 224*a-f* and intermediate sections 225*a-f* similar or identical to the panels 24*a-f* and the intermediate sections 25*a-f*, respectively, of the container 10. The container 200 can be opened by rotationally threading the lid assembly 212 in a downward direction along the threads 219 until the panels 224*a-f* are urged by the to end 216 of the container 200 to shift into an open orientation similar to that shown in FIG. 2. To reclose the container 200, the lid assembly 212 can be rotationally moved upward along the threads 219 until the intersection 226 coincides with or crosses the top end 216 of the container 200 and the panels 224*a-f* shift back to the closed orientation shown in FIG. 11. Thus, instead of moving upward or downward in a linear motion as the lid assembly 12, the lid assembly 212 can move upward or downward in a rotational motion around the central axis of the body 211.

These teachings describe cost-effective and easy to manufacture reclosable containers for food products. The flexible containers have a decorative lid assembly that can reclose the container to preserve the freshness of the food product stored in the container. These reclosable flexible containers can be made entirely from the same material to increase manufacturing efficiency and reduce manufacturing costs.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the concept.

The invention claimed is:

1. A reclosable food container comprising:

a body for storing a food product, the body having a side wall extending between a closed bottom end and a top end including an access opening; and a lid including a collar surrounding the body, the collar having a plurality of panels extending therefrom, the collar being movable relative to the body in a direction between a first position wherein the panels overlie and restrict access to the opening and a second position, the second position being closer to the bottom end of the body than the first position, wherein the panels permit access to the opening, the panels being configured to shift in an outwardly direction during contact with the top end of the body during movement of the collar from the first position toward the second position;

wherein the body is rigid such that a distance from the top end of the side wall of the body to the bottom end of the side wall of the body remains unchanged during movement of the collar from the first position into the second position.

2. The container of claim 1, wherein the lid includes a hinged intersection between the panels and the collar, the intersection being positioned above the top end of the body when the collar is in the first position.

3. The container of claim 2, wherein the hinged intersection is being positioned below the top end of the body when the collar is in the second position.

4. The container of claim 3, wherein the panels shift in the outwardly direction about the hinged intersection during the movement of the collar from the first position toward the second position to permit access to the opening.

5. The container of claim 3, wherein the panels shift in an inwardly direction about the hinged intersection during the movement of the collar from the second position toward the first position to restrict access to the opening.

6. The container of claim 1, wherein the panels are biased toward an inwardly direction.

7. The container of claim 1, wherein each of the panels has two curved sides and a third side forming a linear hinged intersection with the collar.

8. The container of claim 1, wherein the collar and the panels are separated by a fold line.

9. The container of claim 1, wherein at least two adjacent panels are joined via at least one recessed panel, the recessed panel being joined to the adjacent panels by at least one fold line.

10. The container of claim 1, further comprising a stop configured to restrict the collar from moving from the second position past the first position.

11. The container of claim 1, further comprising a stop configured to restrict the collar from moving from the first position toward the bottom end past the second position.

12. The container of claim 1, wherein the panels are configured to form a dome when the collar is in the first position.

13. The container of claim 1, wherein the panels are configured to form a concave surface when the collar is in the first position.

14. The container of claim 1, wherein the collar is configured to rotate and twist at least a portion of the side wall to block access to the opening.

15. The container of claim 1, wherein the side wall includes a first threaded portion and the lid assembly includes a complementary second threaded portion that permits the lid assembly to be attached to the body of the container by rotation, the lid assembly being configured to move from the first position toward the second position by rotational movement along the first threaded portion.

16. A method of using the container of claim 1, the method comprising:

moving the collar in a direction from the first position toward the second position;

bringing the panels into contact with the top end of the body to shift the panels outwardly and permit access to the opening; and removing the food product from the container.

17. The method of claim 16, further comprising moving the collar from the second position toward the first position to allow the panels to shift inwardly at least partially under self-bias to restrict access to the opening.

18. A reclosable food container comprising:

a body for storing a food product, the body having a side wall extending between a closed bottom end and a top end including an access opening; and a lid including a collar surrounding the body, the collar having a plurality of panels extending therefrom, the collar being movable relative to the body in a direction between a first position wherein the panels overlie and restrict access to the opening and a second position, the second position being closer to the bottom end of the body than the first position, wherein the panels permit access to the opening, the panels being configured to shift in an outwardly direction during contact with the top end of the body during movement of the collar from the first position toward the second position, wherein the panels are not in contact with the top end of the body when the collar is in the first position.

19. The container of claim 18, wherein the collar is configured to move from the first position toward the second position in a downward direction away from the top end and toward the bottom end to bring the panels into contact with the top end of the body.

20. The container of claim 19, wherein the top end of the body is configured to urge the panels upward and away from the access opening by the top end of the body when in the contact with the panels during the movement of the collar in the downward direction.

21. A reclosable food container comprising:

a body for storing a food product, the body having a side wall extending between a closed bottom end and a top end including an access opening; and a lid including a collar surrounding the body, the collar having a plurality of panels extending therefrom, the collar being movable relative to the body in a direction between a first position wherein the panels overlie and restrict access to the opening and a second position, the second position being closer to the bottom end of the body than the first position, wherein the panels permit access to the opening, the panels being configured to shift in an outwardly direction during contact with the top end of the body during movement of the collar from the first position toward the second position, wherein at least two adjacent panels are joined via at least one recessed panel, the recessed panel being joined to the adjacent panels by at least one fold line.

22. A reclosable food container comprising:

a body for storing a food product, the body having a side wall extending between a closed bottom end and a top end including an access opening; and a lid including a collar surrounding the body, the collar having a plurality of panels extending therefrom, the collar being movable relative to the body in a direction between a first position wherein the panels overlie and restrict access to the opening and a second position, the second position being closer to the bottom end of the body than the first position, wherein the panels permit access to the opening, the panels being configured to shift in an outwardly direction during contact with the top end of the body during movement of the collar from the first position toward the second position, wherein the panels are configured to form a concave surface when the collar is in the first position.

23. A reclosable food container comprising:

a body for storing a food product, the body having a side wall extending between a closed bottom end and a top end including an access opening; and a lid including a collar surrounding the body, the collar having a plurality of panels extending therefrom, the collar being movable relative to the body in a direction between a first position wherein the panels overlie and restrict access to the opening and a second position, the second position being closer to the bottom end of the body than the first position, wherein the panels permit access to the opening, the panels being configured to shift in an outwardly direction during contact with the top end of the body during movement of the collar from the first position toward the second position, wherein the collar is configured to rotate and twist at least a portion of the side wall to block access to the opening.

24. A reclosable food container comprising:

a body for storing a food product, the body having a side wall extending between a closed bottom end and a top end including an access opening;

a lid including a collar surrounding the body, the collar having a plurality of panels extending therefrom, the collar being movable relative to the body in a direction between a first position wherein the panels overlie and restrict access to the opening and a second position, the second position being closer to the bottom end of the body than the first position, wherein the panels permit access to the opening, the panels being configured to shift in an outwardly direction during contact with the top end of the body during movement of the collar from the first position toward the second position, and a stop configured to restrict the collar from moving from the first position toward the bottom end past the second position, the stop including a flexible film having one end attached to the side wall of the body and an opposite end attached to the collar.

* * * * *